US008657347B2

(12) United States Patent
Liang et al.

(10) Patent No.: US 8,657,347 B2
(45) Date of Patent: Feb. 25, 2014

(54) AUTO LOCK

(75) Inventors: Luke Liang, South Plainfield, NJ (US); David Chen, Guangzheu (CM)

(73) Assignee: Vision Industries Group, Inc.

( * ) Notice: Subject to any disclaimer, the term of this patent is extended or adjusted under 35 U.S.C. 154(b) by 695 days.

(21) Appl. No.: 12/792,972

(22) Filed: Jun. 3, 2010

(65) Prior Publication Data

US 2011/0298225 A1 Dec. 8, 2011

(51) Int. Cl.
*E05C 1/10* (2006.01)

(52) U.S. Cl.
USPC ..... 292/175

(58) Field of Classification Search
USPC ..... 292/175, DIG. 20
See application file for complete search history.

(56) References Cited

U.S. PATENT DOCUMENTS 5,671,958 A * 9/1997 Szapucki et al. ..... 292/175
5,806,900 A * 9/1998 Bratcher et al. ..... 292/137
6,183,024 B1 * 2/2001 Schultz et al. ..... 292/175
6,722,712 B2 * 4/2004 Schultz ..... 292/175
6,874,826 B1 * 4/2005 Polowinczak et al. ..... 292/175
7,118,142 B2 * 10/2006 Xu ..... 292/139
7,261,342 B2 * 8/2007 Smith ..... 292/332
7,407,199 B2 8/2008 Richardson
2008/0012357 A1 1/2008 Liang

* cited by examiner

*Primary Examiner* — Carlos Lugo
*Assistant Examiner* — Mark Williams
(74) *Attorney, Agent, or Firm* — Thomas A. O'Rourke; Bodner & O'Rourke, LLP

(57) ABSTRACT

The present invention addresses the need of the industry for a simple and comfortable latch mechanism that automatically latches a window when the window is returned to a closed position. A latch mechanism for a window includes a housing defining an opening therein, a latch bolt slidably disposed in the housing and selectively positionable between an extended position and a retracted position wherein such latch bolt is adapted to be actuated by an actuating mechanism from the retracted position to the extended position, and a stopping mechanism adapted to automatically engaged and retain the latch bolt in the retracted position as the latch bolt is positioned from the extended to the retracted position.

22 Claims, 24 Drawing Sheets

118

Locked position

Unlocked position

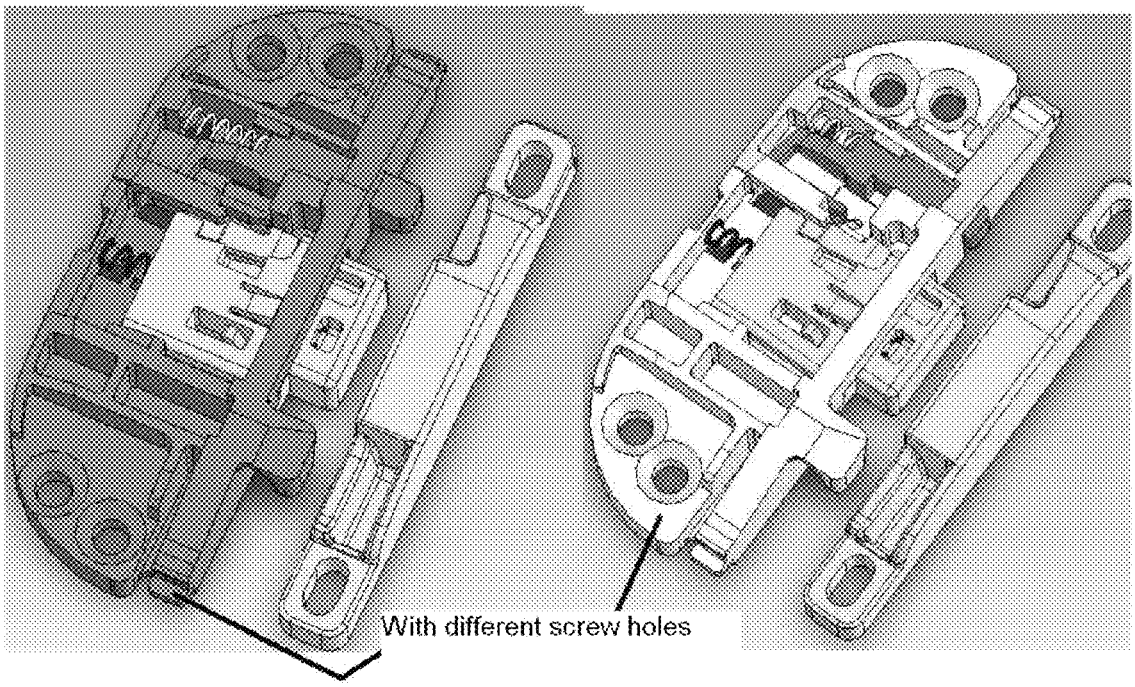
FIG. 15-A

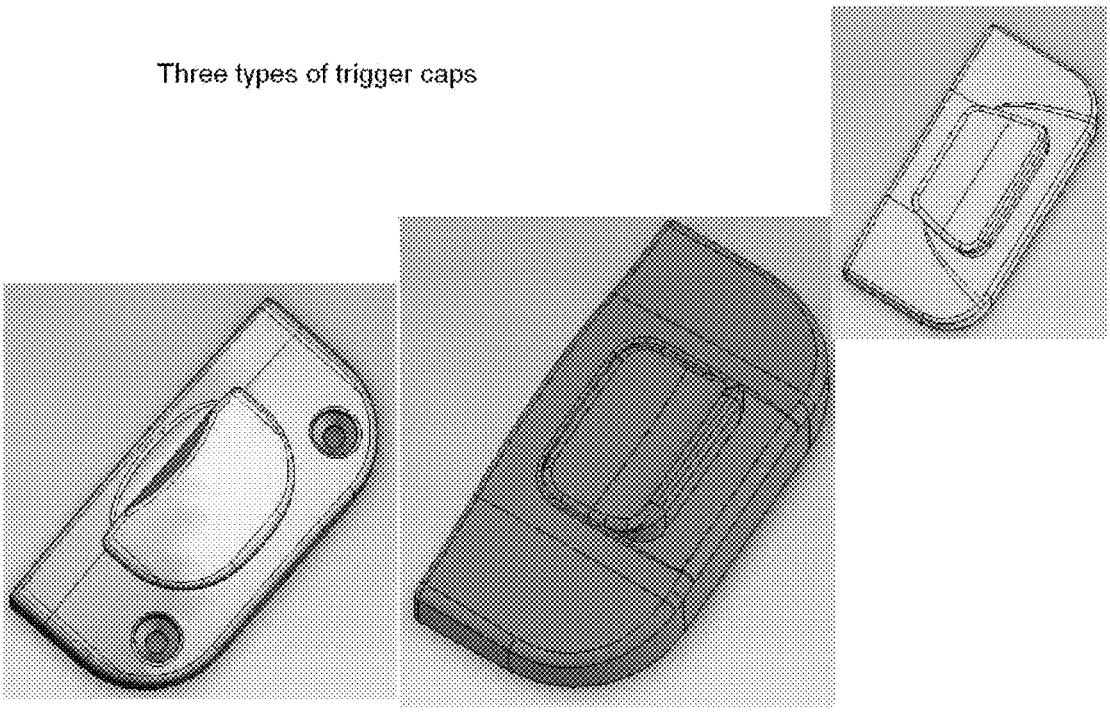
FIG. 15-B

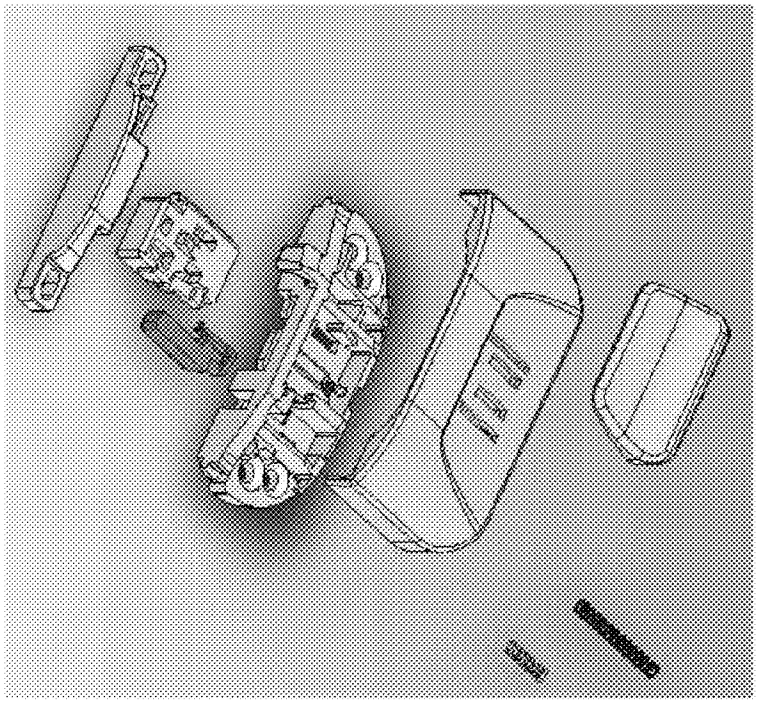
FIG. 15-C

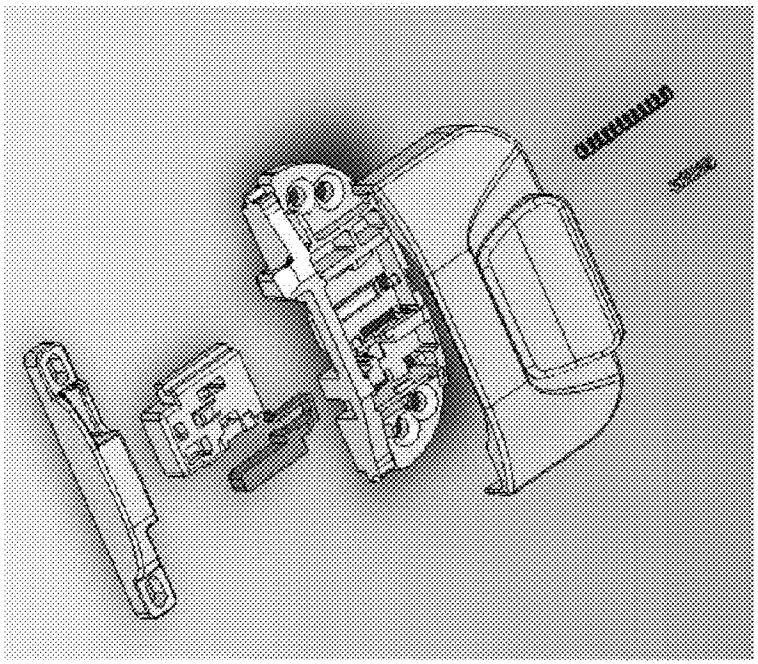
FIG. 15-D

With screw holes hidden
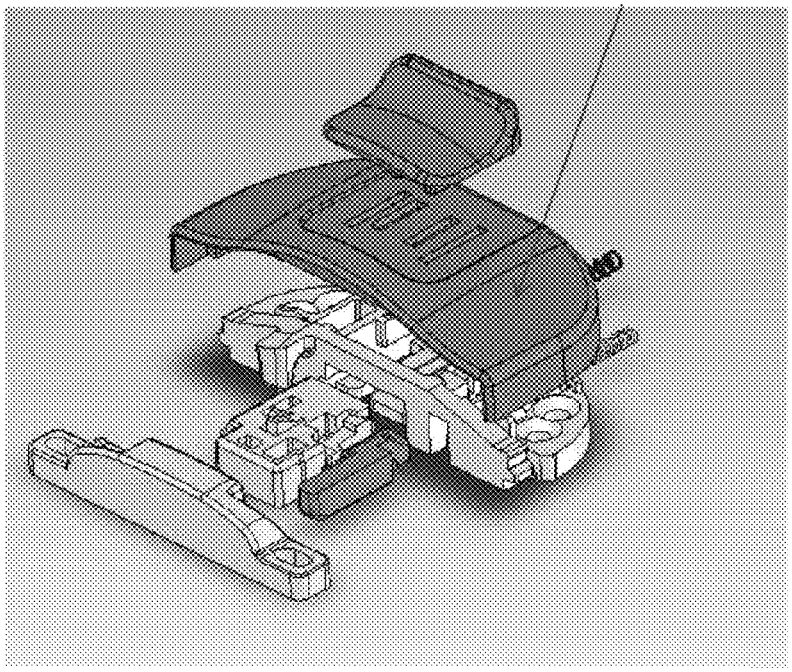
FIG. 15-E

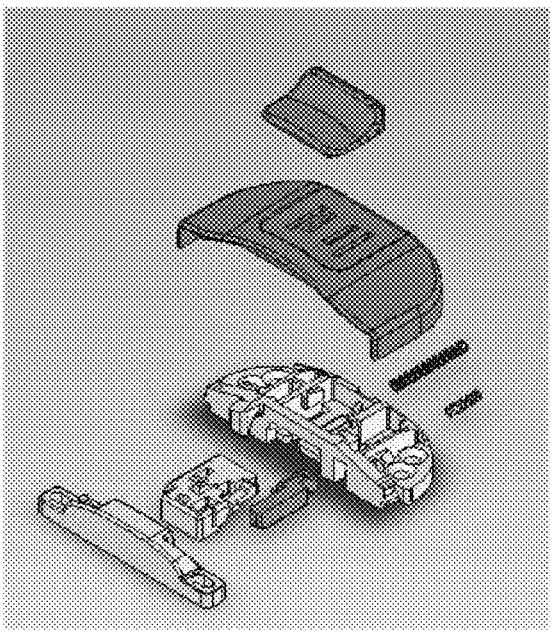
FIG. 15-F

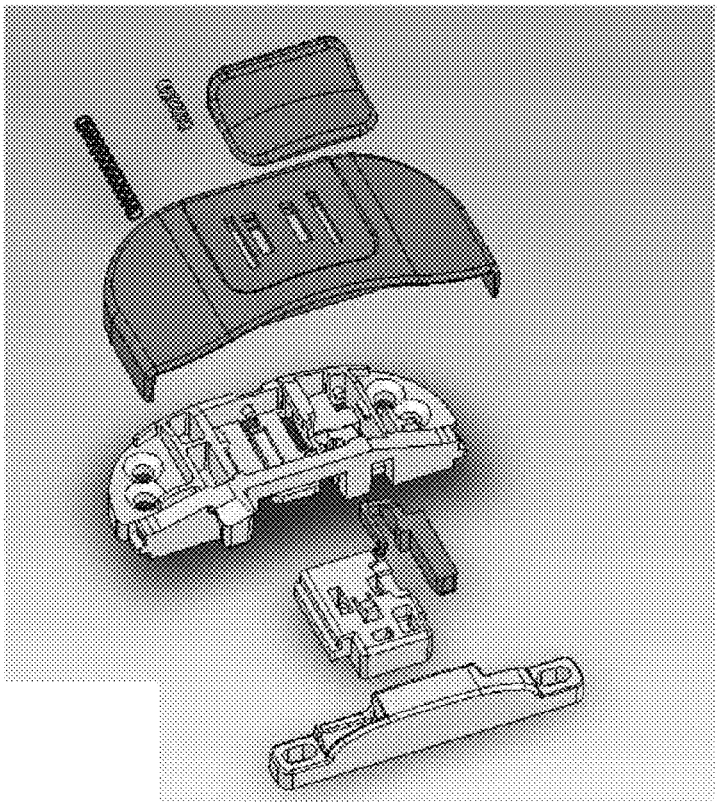
FIG. 15-G

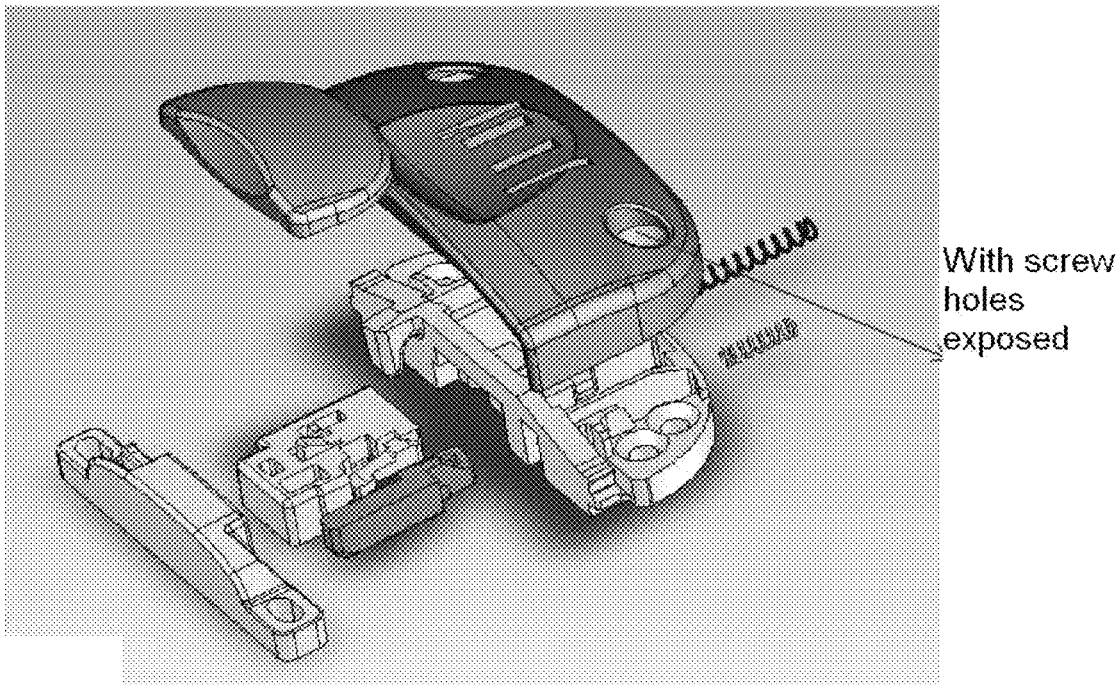
FIG. 15-H

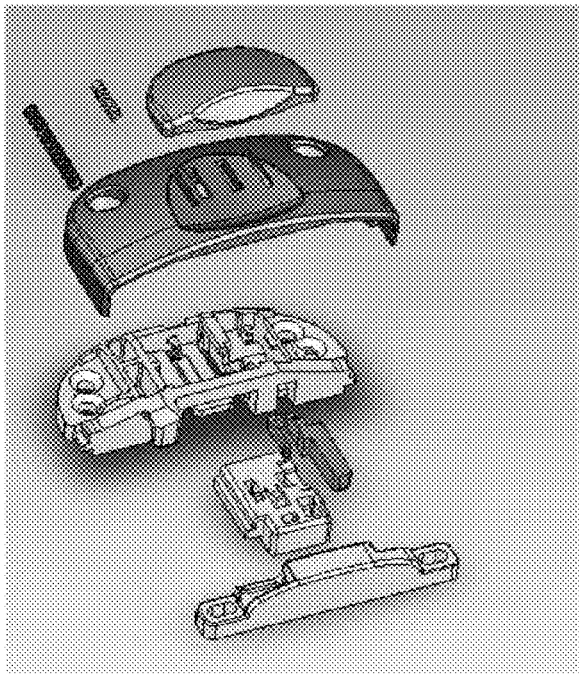
FIG. 15-I

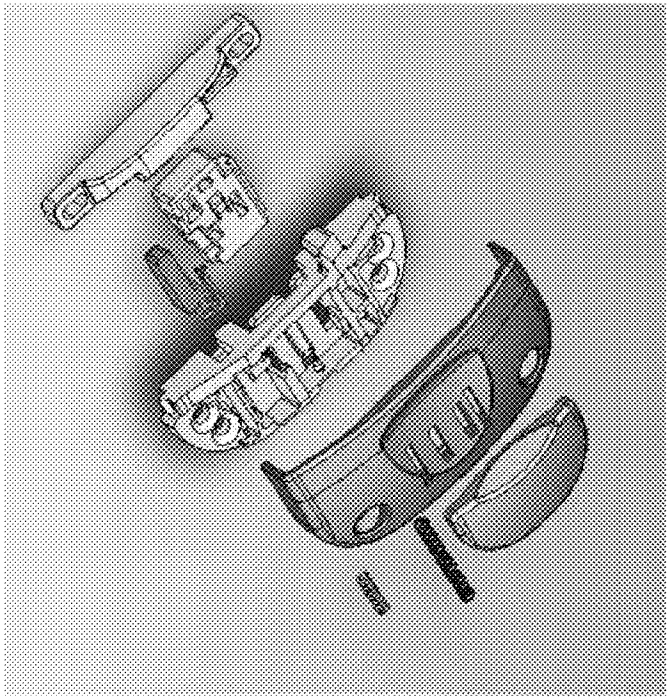
FIG. 15-J

AUTO LOCK

TECHNICAL FIELD

The present invention relates to windows, and more specifically, to latching mechanisms for windows.

BACKGROUND OF INVENTION

Double hung and other sliding sash type windows are very common. Typically, a latch or locking mechanism is used to secure the sashes in place to inhibit unintentional opening of the sashes and unauthorized entry to the structure.

One very common mechanism used to lock sashes together is the so-called check rail lock, which includes a sweep cam attached to a rotatable handle. The check rail lock is mounted on one of the sashes, usually the lower sash of a double-hung window proximate the center of the sash rail. A keeper structure is mounted on the other sash proximate the check rail lock. As the handle is rotated in either direction, the sweep cam is rotated into or out of engagement with the keeper in order to enable locking or opening of the window as desired. A drawback of these devices, however, is that the handle can be rotated so that the sweep cam is extended even when the sash is open. When the sash is closed with the sweep cam in such position, the extended position of the sweep cam prevents full closure of the sash. The operator of the window may not notice the window is not fully closed and latched. In addition, the sweep cam may strike and damage the other sash.

Another prior mechanism includes a sliding latch bolt that may be mounted on one sash and that is selectively engageable with a keeper mounted on the other sash. A drawback with these mechanisms, however, is often that the bolt must be held in a retracted position as the window is operated. In other case, where a mechanism for holding the bolt in a retracted position is employed, the bolt either releases as soon as the window is raised, or must be manually released with a separate catch or button. In such cases, the window may fail to close fully and may not be noticed by the operator of the window.

Some prior mechanisms have tried to solve the above problems, but the solutions are relatively complicated for manufacturers and customers. What is still needed is a more simple and comfortable latch mechanism for a window that automatically latches when the window is returned to a closed position.

SUMMARY OF THE INVENTION

The present invention addresses the need of the industry for a simple and comfortable latch mechanism that automatically latches a window when the window is returned to a closed position. According to an embodiment of the invention, a window is equipped with a latch mechanism having a latch bolt and a spring driven actuating mechanism in the housing of the latch mechanism. The latch mechanism is mounted on a sash of a window assembly opposite a keeper or similar latch bolt receiving structure. With the window in a closed position, the latch bolt of the latch mechanism is received in the keeper to latch the sashes together, and the actuating mechanism is confined in a retracted position by the keeper. To open the window, the latch mechanism is disengaged from the keeper by grasping a finger grip on a trigger cap and pulling outwardly away from keeper. The latch bolt slides out of the keeper and goes into the housing, and the actuating mechanism is released by the keeper and extends outwardly from the housing and reaches an extended position. The latch bolt is held in a retracted position by a stopping mechanism in the housing of the latch mechanism. With the latch bolt in this position, the sash may be moved to open the window. To close the window, the sash with the latch mechanism is moved toward the keeper. The outwardly extending portion of the actuating mechanism contacts the keeper that pushes the actuating mechanism inwardly into the housing. The actuating mechanism actuates the latch bolt and disengages the latch bolt from the stopping mechanism. A spring urges the latch bolt forwardly so that it is once again engaged in the keeper and the sashes are latched together as before. According to one embodiment, when latch bolt is in the retracted position, it can also be disengaged from the holding mechanism by pushing the finger grip toward the extended position of the latch bolt. The finger grip can move along a curved track on the curved upper surface of the housing.

According to one embodiment, a latch mechanism for a window includes a housing defining an opening therein, a latch bolt slidably disposed in the housing and selectively positionable between an extended position and a retracted position wherein such latch bolt is adapted to be actuated by an actuating mechanism from the retracted position to the extended position, and a stopping mechanism adapted to automatically engaged and retain the latch bolt in the retracted position as the latch bolt is positioned from the extended to the retracted position. There is a sliding ridge on the inside surface of the housing, and the sliding ridge defines the moving track of a sliding contactor on an actuating mechanism. The actuating mechanism includes a contacting pin adapted to slide along a closed curve defined by the sliding ridge, wherein the actuating mechanism is arranged to extend outwardly from the housing without actuating the latch bolt as the contacting pin goes along one section of the closed curve, and to retract inwardly to the housing and actuate the latch bolt as the contracting pin goes along the other section of the closed curve.

Embodiments of the housing of the latch mechanism may include a top cover and a bottom cover. A hook mechanism and a plug-socket mechanism are coupled with the top cover and the bottom cover. The top and the bottom covers can be held together in two steps. The first step is that the plug-socket mechanism holds the top cover and the bottom cover together when the hook mechanism does not hold the top cover and the bottom cover. The second step is that the hook mechanism holds the top cover and the bottom cover together with the plug-socket mechanism.

The advantage of this invention is a simple and comfortable solution for manufacturers and consumers to manufacture, assemble, install, and use an automatic latch for a window.

BRIEF DESCRIPTION OF THE DRAWINGS

FIG. 15 A-J show different embodiments with various trigger caps and screw holes.

DETAILED DESCRIPTION OF THE INVENTION

Figure 1:
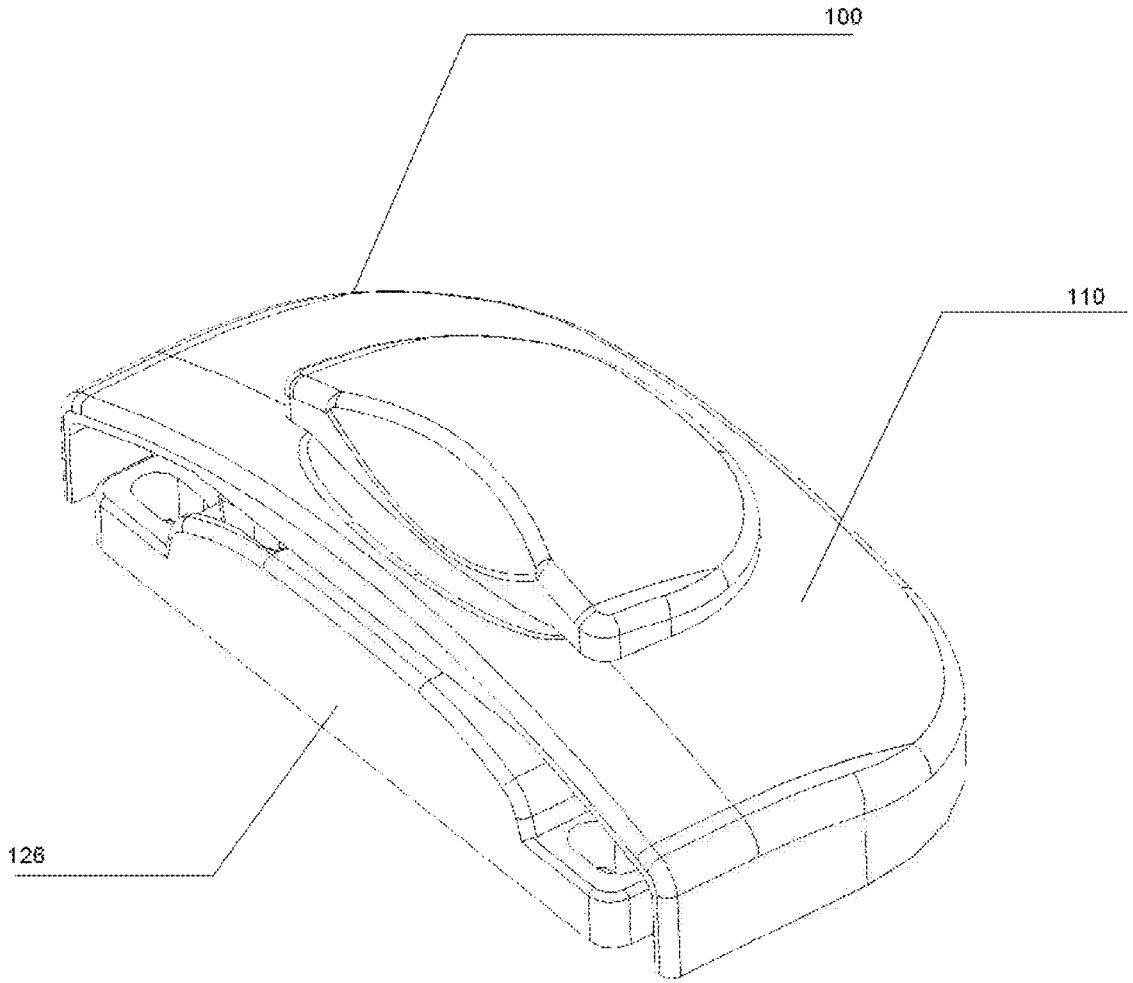
FIG. 1 is one exemplary embodiment of this invention.
Figure 2:
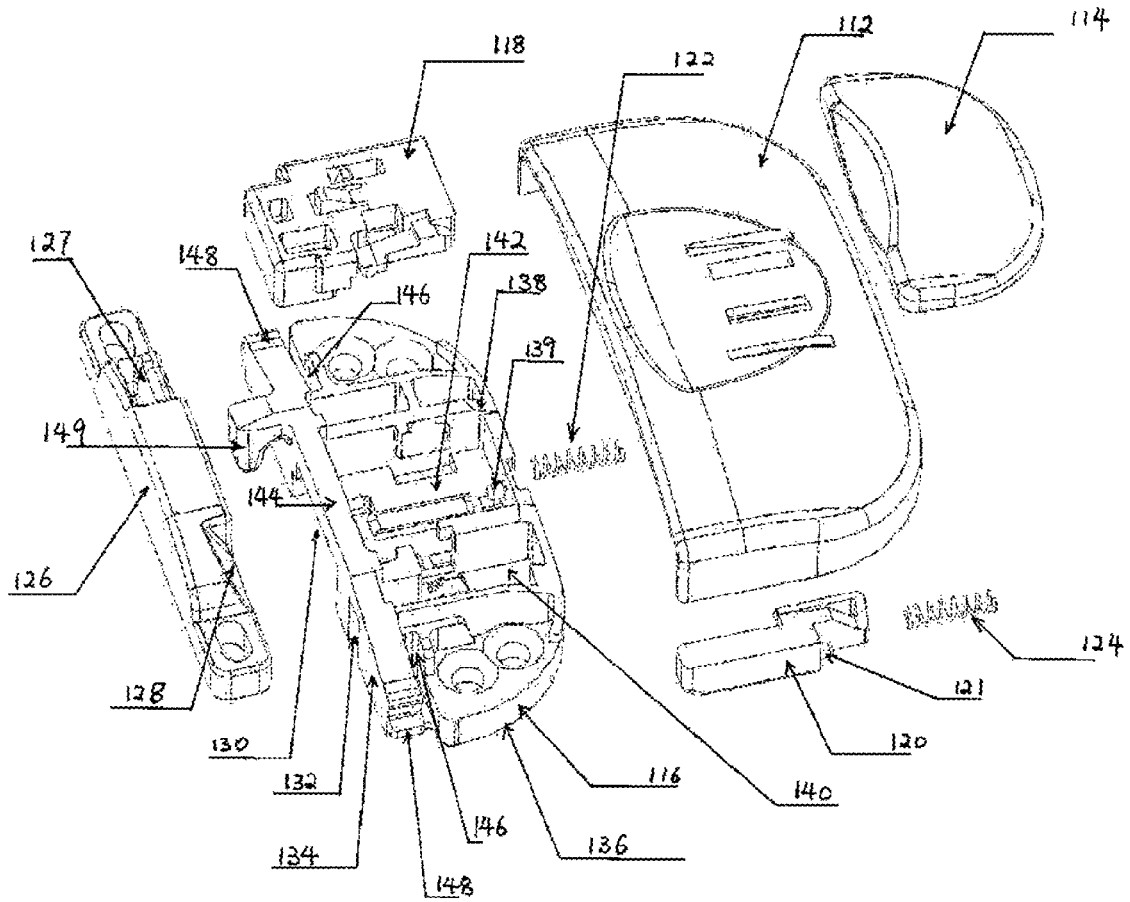
FIG. 2 is a top exploded view of the exemplary embodiment in FIG. 1.

FIG. 1 is one exemplary embodiment of this invention. FIG. 2 is a top exploded view of the exemplary embodiment in FIG. 1. Latch mechanism 100 generally includes housing 110 (shown in FIG. 1), latch bolt 118, trigger cap 114, one resilient element that can be base spring 122, actuator 120, and another resilient element that can be actuator spring 124. Latch mechanism 100 and latch keeper 126 together constitute a lock mechanism 99 (shown in FIG. 1). Those skilled in the art will realize and understand, upon reading this description, that other and or different resilient elements may be used to fulfill the same function. Housing 110 generally includes top cover 112 and base cover 116. Base cover 116 generally includes front wall 134, rear wall 138, and bottom wall 136. Front wall 134 and bottom wall 136 together define openings known as latch bolt aperture 130 and actuator aperture 132. Rear wall 138 includes base spring post 139. Base cover 116 further has actuator guide slot 140, latch bolt guide slot 142, and latch bolt aperture beam 144. Actuator guide slot 140 and latch bolt guide slot 142 extend from front wall 134 to rear wall 138. Latch keeper 126 generally includes latch keeper socket 127, keeper bevel wall 128, and latch bolt receiver 125 (shown in FIG. 3).

Figure 3:
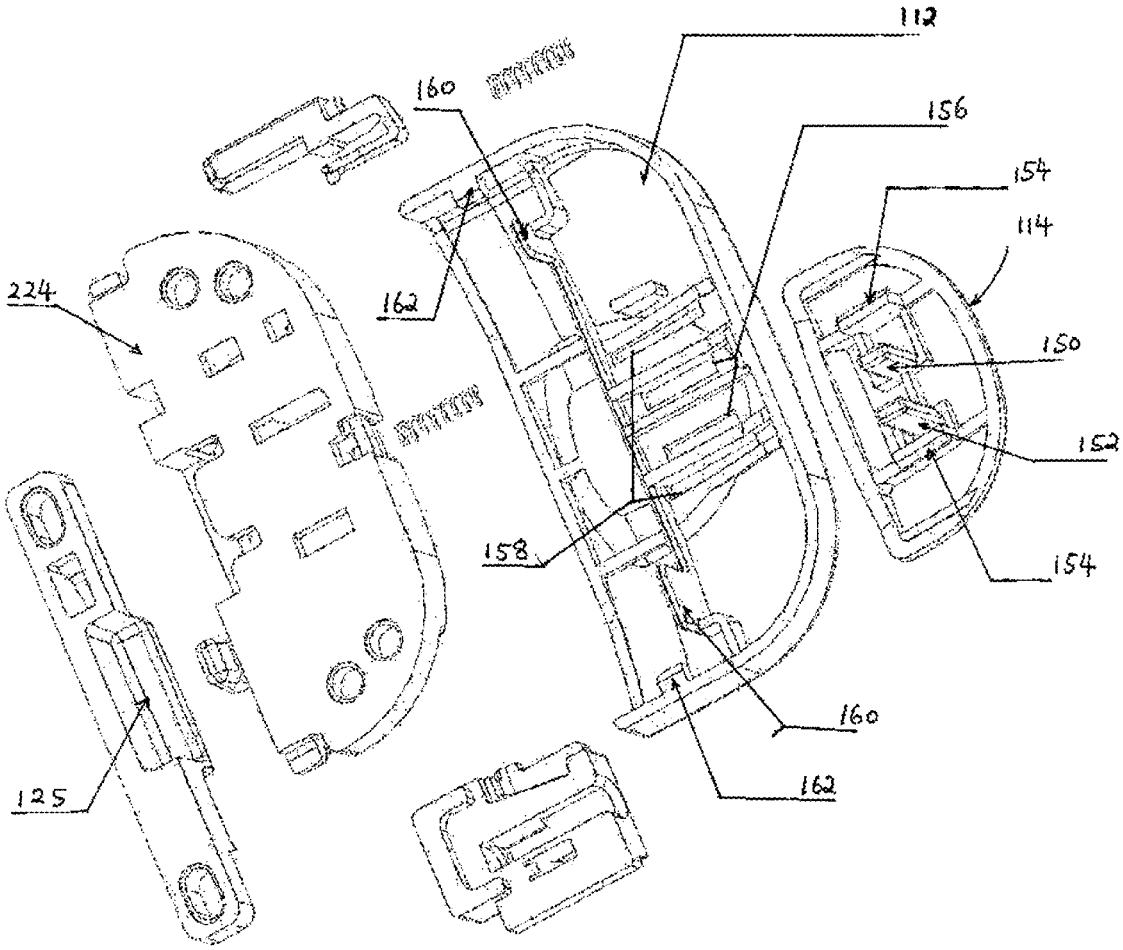
FIG. 3 is a bottom exploded view of the exemplary embodiment in FIG. 1.

FIG. 3 is a bottom exploded view of the exemplary embodiment in FIG. 1. Trigger cap 114 generally includes short cap shaft 150, long cap shaft 152, and a pair of cap hooks 154. Top cover 112 generally includes a pair of top cover slots 156, a pair of cap hook guide slots 158, a pair of upper plugs 160, and a pair of upper hooks 162.

Figure 4:
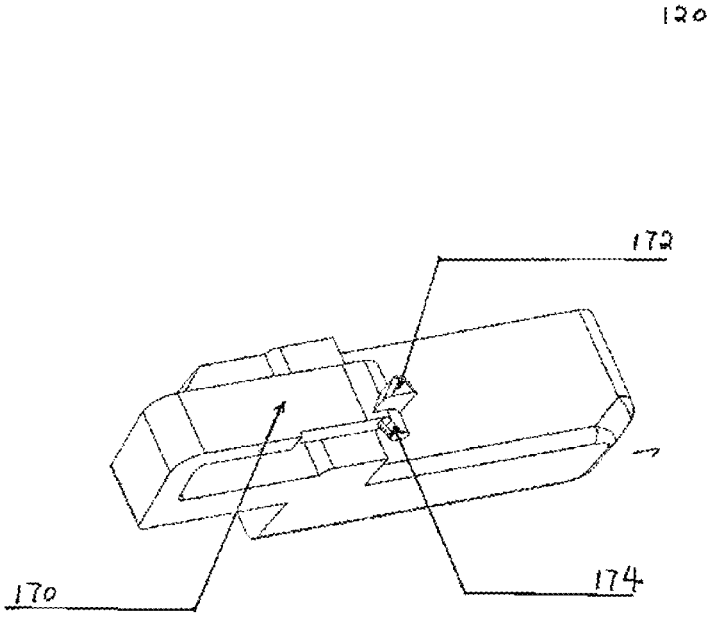
FIG. 4 is a detailed view of the actuator in FIG. 1.

FIG. 4 is a detailed view of actuator 120 in FIG. 1. Actuator 120 generally includes actuator spring post 121 (shown in FIG. 3), actuator arm 170, actuating pin 172, and a sliding contactor known as contacting pin 174. Those skilled in the art will realize and understand, upon reading this description, that other and or different sliding contactors may be used to fulfill the same function.

Figure 5:
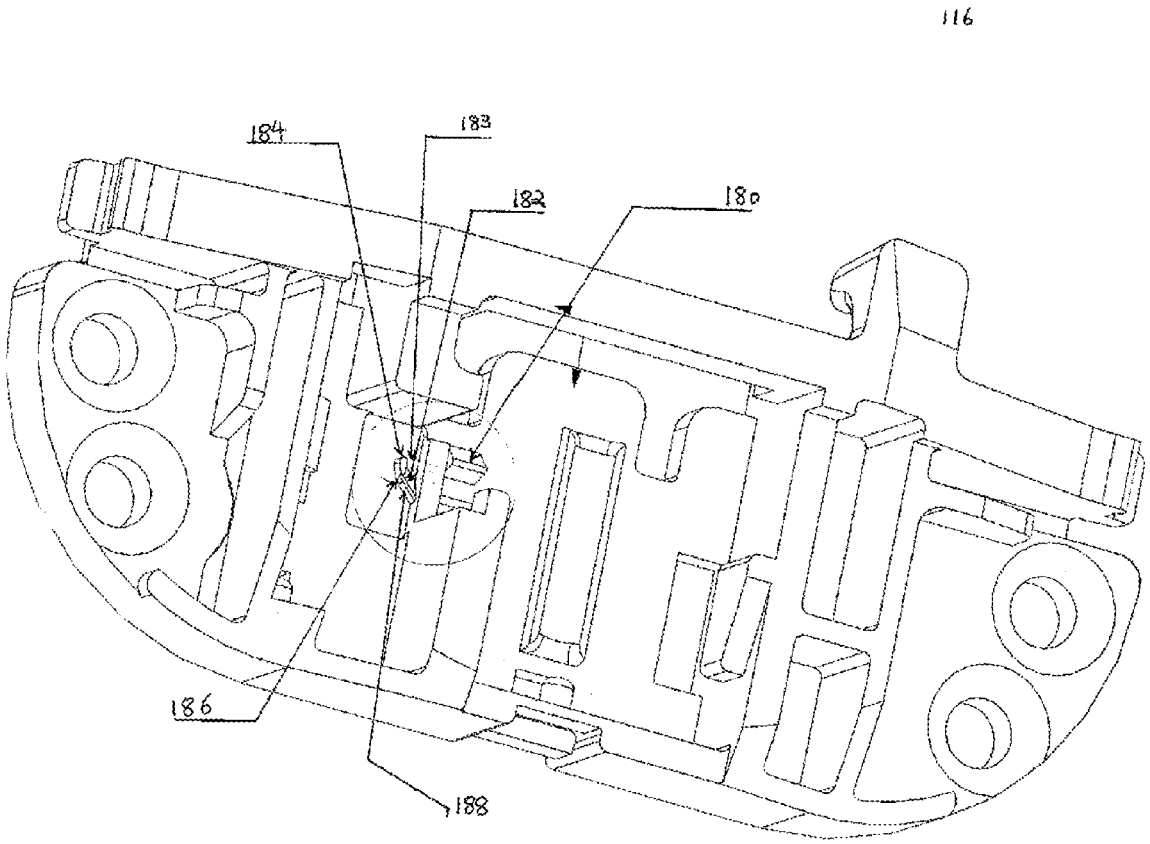
FIG. 5 is a detailed view of the base cover in FIG. 1.

FIG. 5 is a detailed view of base cover 116. Base cover 116 further includes base stopping pin 180, base chamfer 182, harbor area 183, base stud 184, base arc side 186, and base limit wall 188. Base stopping pin 180 and latch stopping pin 196 (shown in FIG. 6) constitute a stopping mechanism. Those skilled in the art will realize and understand, upon reading this description, that other and or different stopping mechanisms may be used to fulfill the same function.

Figure 6:
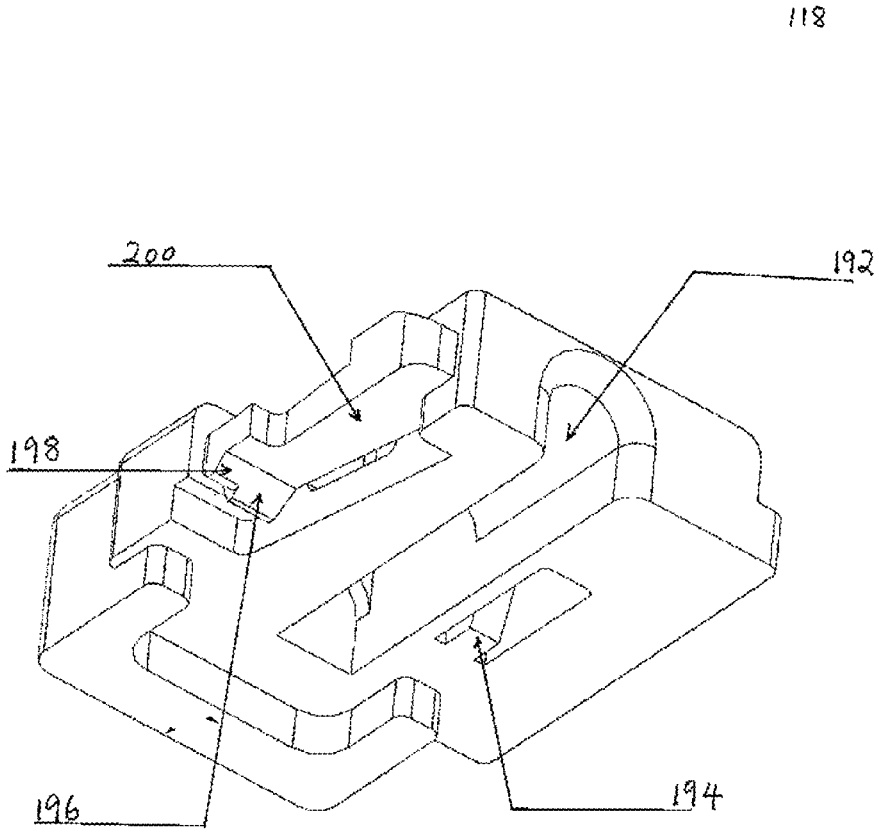
FIG. 6 is a detailed bottom view of the latch bolt in FIG. 1.
Figure 7:
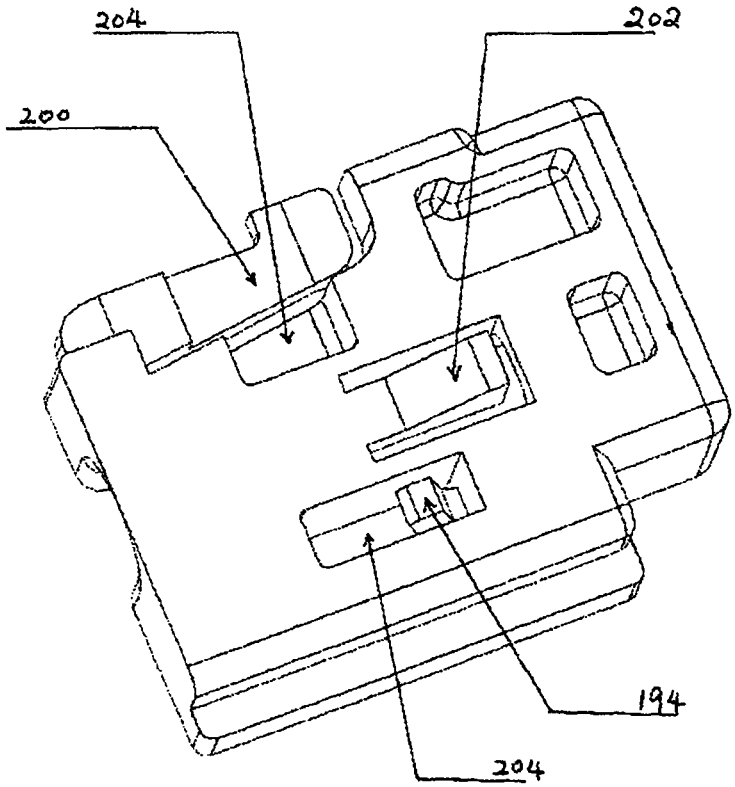
FIG. 7 is a detailed top view of the latch bolt in FIG. 1.

FIG. 6 is a detailed bottom view of latch bolt 118. Latch bolt 118 generally includes base spring slot 192, flexible tab 194, latch stopping pin 196, latch trigger pin 198, and latch bolt arm 200. FIG. 7 is a detailed top view of latch bolt 118. Latch bolt 118 further includes a confining element and a pair of latch bolt slots 204. One embodiment of the confining element can be latch assembly limit 202.

In addition, those skilled in the art will realize and understand, upon reading this description, that other and or different architectures may be used to build this invention.

Figure 8:
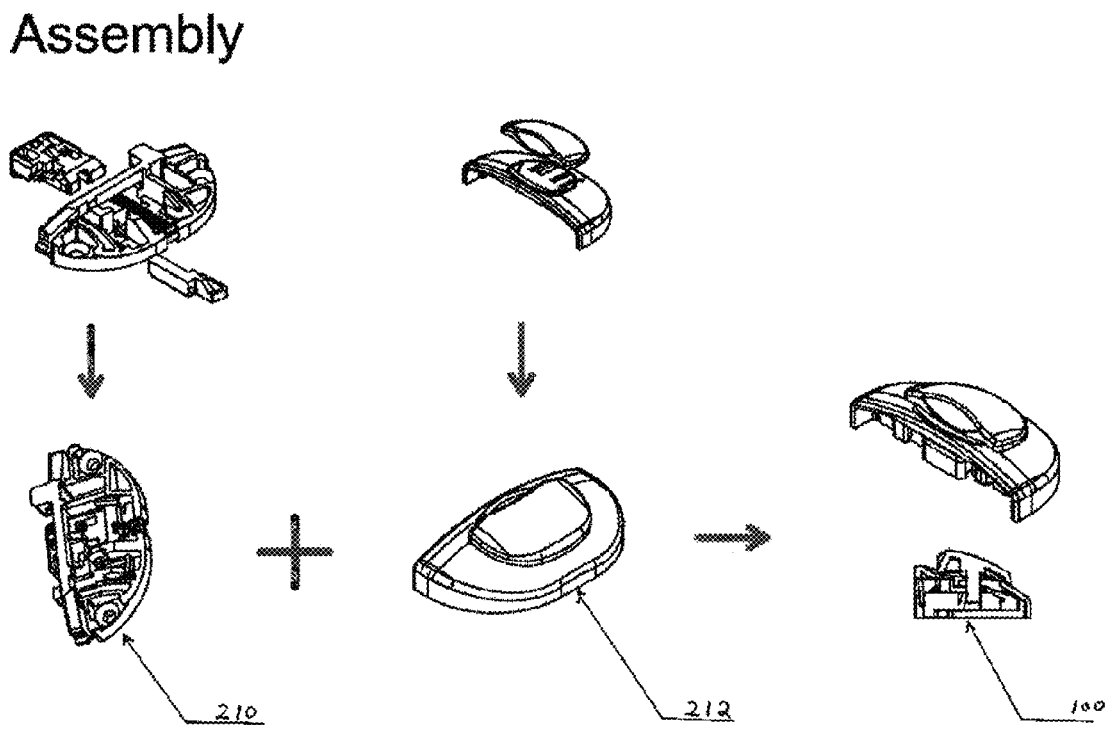
FIG. 8 is one exemplary assembly process of the latch mechanism in FIG. 1.

One exemplary assembly process is shown in FIG. 8. The exemplary assembly process generally includes the flowing steps. Base spring 122 is mounted on base spring post 139. Latch bolt 118 is positioned through latch bolt aperture 130 into latch bolt guide slot 142, wherein base spring 122 fits into base spring slot 192. Actuator spring 124 is mounted in the actuator guide slot 140. Actuator 120 is positioned into actuator guide slot 140 with actuator spring post 121 fitting into actuator spring 124 and with actuator 120 extending from actuator aperture 132. These steps lead to assembled base cover 210 (shown in FIG. 8).

Trigger cap 114 is slidably disposed on top cover 112 with short cap shaft 150 and long cap shaft 152 extending through each of top cover slots 156 and with each of cap hooks 154 extending through a separate one of cap hook guide slots 158. These steps lead to assembled top cover 212 (shown in FIG. 8).

Assembled top cover 212 is mounted on assembled base cover 210 with short cap shaft 150 and long cap shaft 152 fitting into a separate one of latch bolt slots 204, with each one of upper plugs 160 fitting into a separate one of bottom slots 146, and with each one of upper hooks 162 snapping on a separate one of bottom hooks 148. These steps lead to latch mechanism 100. The upper hooks 162 and the bottom hooks 148 constitute a hook mechanism. The upper plugs 160 and the bottom slots 146 constitute a plug-socket mechanism. Those skilled in the art will realize and understand, upon reading this description, that other and or different hook mechanisms and plug-socket mechanisms may be used to fulfill this assembling process.

Figure 9:
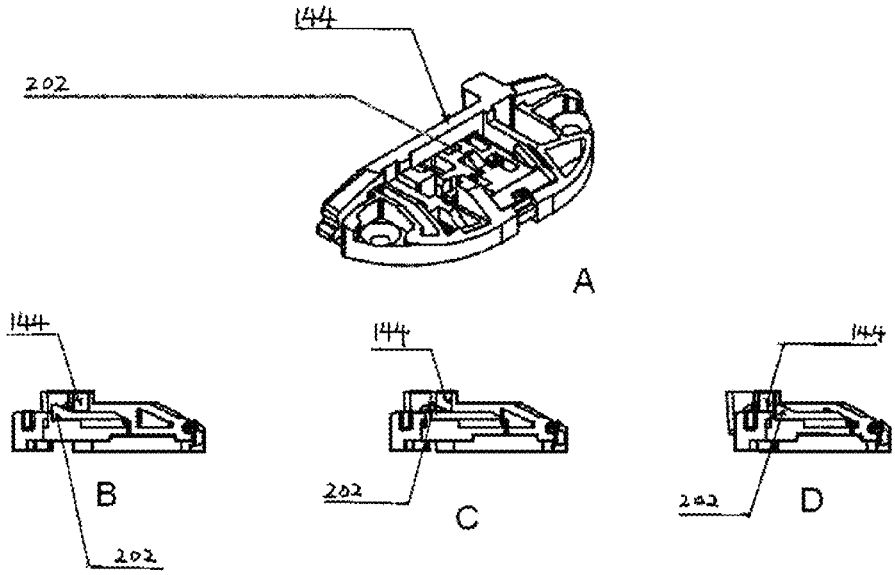
FIG. 9 A-D show a detailed process of assembling a latch bolt into a base cover.

FIG. 9 A-D show a detailed process of assembling latch bolt 118 into base cover 116. Latch bolt 118 is positioned into base cover 116 from the front side of base cover 116 to the rear side of base cover 116 through latch bolt aperture 130. This process can be viewed in three steps. First, part of latch bolt 118 is pushed into base cover 116 with latch assembly limit 202 out of base cover 116 (shown in FIG. 9-B). Second, latch bolt 118 is further pushed into base cover 116 with latch assembly limit 202 is pressed downward by latch bolt aperture beam 144 (shown in FIG. 9-C). Third, latch bolt 118 is still further pushed into base cover 116 with latch assembly limit 202 in base cover 116 (shown in FIG. 9-D). In step three, latch assembly limit 202 pops up when it clears latch bolt aperture beam 144, and latch bolt aperture beam 144 confines latch assembly limit 202 and whereby confines latch bolt 118 in base cover 116. With limit device such as latch assembly limit 202, those skilled in the art will realize and understand, upon reading this description, that other and or different mechanisms may be used to fulfill this assembling process.

Figure 10:
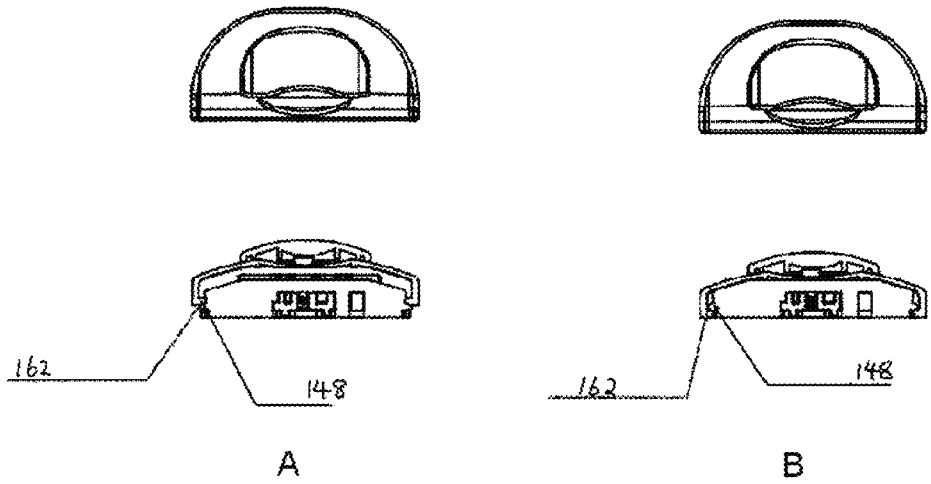
FIG. 10 A-B show a detailed process of mounting the assembled top cover to the assembled base cover.

FIG. 10 A-B show a detailed process of mounting assembled top cover 212 to assembled base cover 210. This process can be viewed in two steps. First, assembled top cover 212 is mounted an assembled base cover 210 with each one of upper plugs 160 fitting into a separate one of bottom slots 146 and with each one of upper hooks 162 being resisted by a separate one of bottom hooks 148. This step leads to a so-called semi-assembly status. Second, assembled top cover 212 is further mounted on assembled base cover 210 with each one of upper plugs 160 fitting into a separate one of bottom slots 146 and also with each one of upper hooks 162 holding a separate one of bottom hooks 148. This step leads to a so-called final-assembly status. In the semi-assembly status, assembled top cover 212 can be disassembled from assembled base cover 210 easily. In the final-assembly, assembled top cover 212 snaps on assembled base cover 210, and it is relatively hard to disassemble the latch mechanism 100. With a double mounting mechanism such as the one discussed above, those skilled in the art will realize and understand, upon reading this description, that other and or different mechanisms may be used to fulfill this double mounting process.

Figure 11:
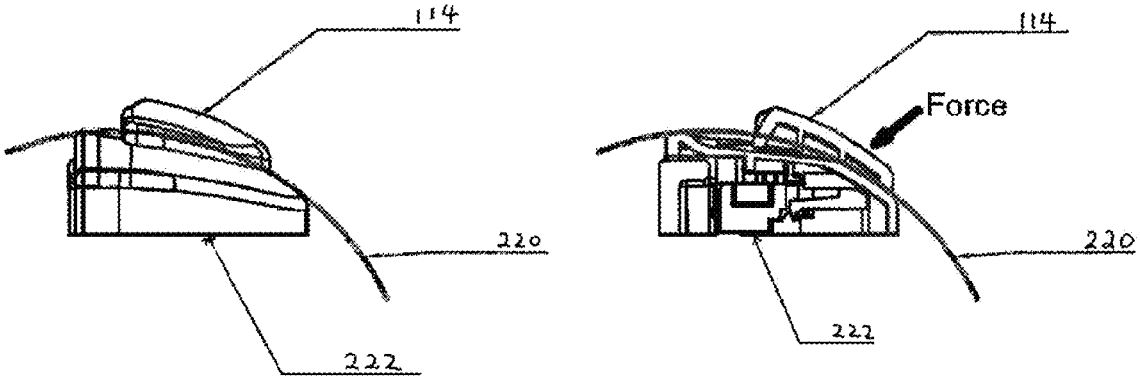
FIG. 11 shows the sliding track of the trigger cap on the arc side of the top cover.
Figure 12:
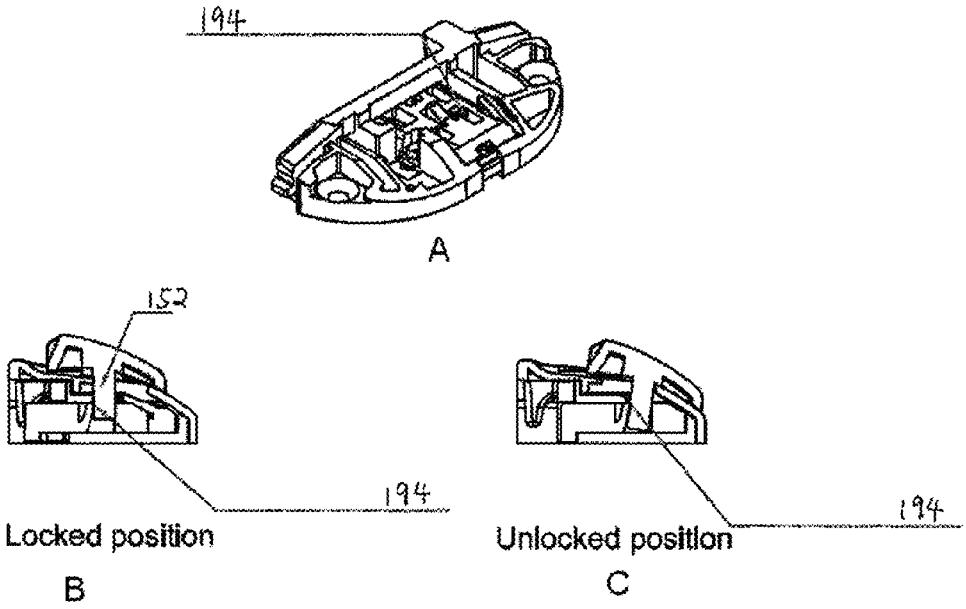
FIG. 12 A-C show detailed connection between the trigger cap and the latch bolt in the locked position and unlocked position of the latch mechanism.

FIG. 11 shows the sliding track of trigger cap 114 on the arc side of top cover 112. During the operation of trigger cap 114, it slides along top cover meridian 220 to shift latch mechanism 100 between an extending (locked) position and a retracted (unlocked) position. Top cover meridian 220 is a curve whose projection on base surface 224 (shown in FIG. 3) is straight line 222. Straight line 222 parallels with the sliding orientation of latch bolt 118. FIG. 12 A-C show detailed circumstances of the locked position and unlocked position of latch mechanism 100. Latch bolt 118 has a pair of latch bolt slots 204, one of which has flexible tab 194. The bottom part of flexible tab 194 is connected to latch bolt 118. This gives flexible tab 194 resilience so that flexible tab 194 can define a variable room for one of latch bolt slots 204. Long cap shaft 152 extends into one of the latch bolt slots 204 with flexible tab 194. During the sliding process of trigger cap 114 from locked position and unlocked position, long cap shaft 152 is continuously pressed by flexible tab 194. This improves preferable contact between trigger cap 114 and latch bolt 118. With a flexible tab, those skilled in the art will realize and understand, upon reading this description, that other and or different mechanisms may be used to fulfill this curve sliding track and preferable contact. Since in the locked position, base stopping pin 180 (shown in FIG. 5) and latch stopping pin 196 (shown in FIG. 6) contacts with each other on their inclined surface, when a force is pushing trigger cap 114 toward front wall 134, latch stopping pin 196 is able to pass the limitation of base stopping pin 180 if the force is larger than the resistant force from base stopping pin 180. Therefore, latch bolt 118 can be actuated not only by actuator 120, but also by trigger cap 114 manually.

Figure 13:
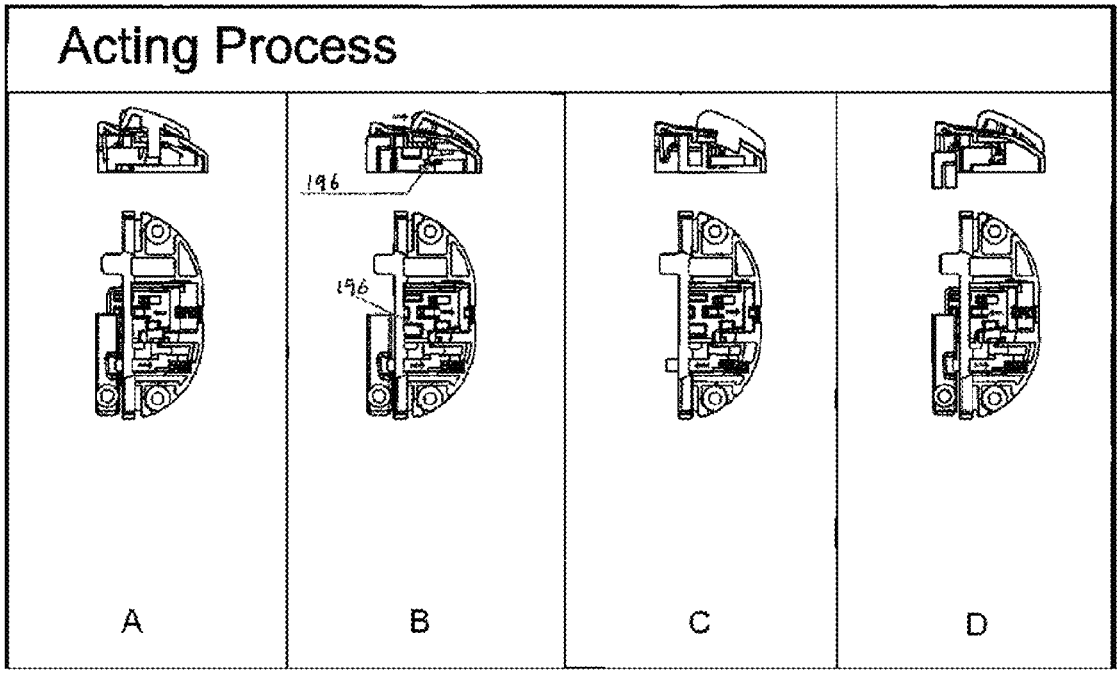
FIG. 13 A-D show an acting process of a latch mechanism.

FIG. 13 A-D show an acting process of latch mechanism 100. FIG. 13 A depicts a locked position of latch mechanism 100. Latch bolt 118 extends out of housing 110 and is received by latch bolt receiver 125 on latch keeper 126. Actuator 120 is in a retracted position and resisted by bevel wall 128 (shown in FIG. 2) on latch keeper 126. One embodiment of latch mechanism 100 is applied on a double hung window. In the locked position for a hung window, latch hook 149 (shown in FIG. 2) is received by latch keeper socket 127 (shown in FIG. 2). FIG. 13 B depicts the action to an unlock position. By operating trigger cap 114, latch bolt 118 retracts into housing 110 and is kept into this position by latch stopping pin 196 engaged with base stopping pin 180. Before latch mechanism 100 moves away from latch keeper 126, actuator 120 is still in the retracted position. FIG. 13 C depicts the unlocked position. Latch bolt 118 is positioned in a position completely retracted in housing 110. Actuator 120, without limitation from bevel wall 128, extends outwardly from housing 110 under the pressure of actuator spring 124 (shown in FIG. 2). FIG. 13 D depicts the action to the locked position. After actuator 120 contacts bevel wall 128 on latch keeper 126, bevel wall 128 pushes actuator 120 into housing 110. Actuator 120 actuates and unlocks latch bolt 118 when actuator 120 is pushed into housing 110. Latch bolt 118 is unlocked by actuator 120 and extends out of housing 110 under the pressure of base spring 122 (shown in FIG. 2). Latch bolt 118 is received by latch bolt receiver 125. Latch mechanism 100 is in the locked position as before.

Figure 14:
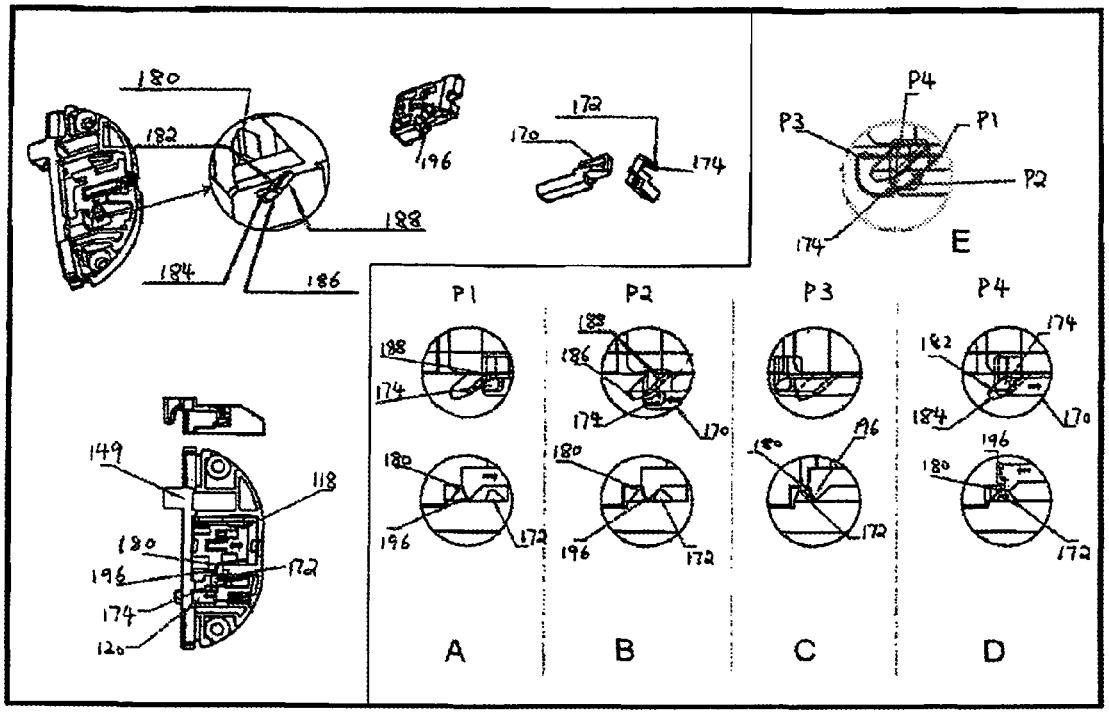
FIG. 14 A-E show a detailed actuating process of a latch mechanism.

FIG. 14 A-E show a detailed actuating process. Contacting pin 174 of actuator 120 is moved along track P1-P2-P3-P4 (shown in FIG. 14 E). Track P1-P2-P3-P4 is a closed curve. Those skilled in the art will realize and understand, upon reading this description, that other and or different tracks or curves may be used to fulfill this actuating process. FIG. 14 A shows the actuating process in section P1, where actuator 120 is pressed by bevel wall 128 into housing 110 and latch bolt 118 is placed in the retracted position by operating trigger cap 114. Latch bolt 118 is limited to this position by latch stopping pin 196 engaged with base stopping pin 180. Contacting pin 174 is between base limit wall 188 and rear wall 138. This is the circumstance shown in FIG. 13 B. FIG. 14 B shows the actuating process in section P2, where latch bolt 118 is kept in its retracted position and actuator 120 is extending outwardly from housing 110 under the pressure of actuator spring 124. While actuator arm 170 moves forward, contacting pin 174 keeps touching base limit wall 188 and moves along base arc side 186, and therefore, actuating pin 172 circumvents latch trigger pin 198 (shown in FIG. 6). This is the circumstance shown in FIG. 13 C. FIG. 14 C shows the actuating process in section P3, where actuator 120 extends to a complete extending position. Contacting pin 174 passes base stud 184 and goes into harbor area 183 (shown in FIG. 5). FIG. 14 D shows the actuating process in section P4, where actuator 120 contacts bevel wall 128 on latch keeper 126 and bevel wall 128 pushes actuator 120 into housing 110 (also shown in FIG. 13 D). During this process, contacting pin 174 slides backward along base chamfer 182, wherein actuating pin 172 lifts latch trigger pin 198, which disengages latch stopping pin 196 from base stopping pin 180. Latch bolt 118, without the limitation from base stopping pin 180, extends outwardly from housing 110 under the pressure of base spring 122. Base chamfer 182, base stud 184, base arc side 186, and base limit wall 188 constitute a sliding ridge defining the sliding track (a closed curve) for contacting pin 174. Those skilled in the art will realize and understand, upon reading this description, that other and or different sliding ridges may be used to fulfill this actuating process. Those skilled in the art will also realize and understand, upon reading this description, that other and or different mechanisms may be used to fulfill this actuating process.

FIG. 15 A-J show different embodiments with various trigger caps and screw holes. The latch mechanism disclosed here can be equipped with various trigger caps. FIG. 15 B gives three exemplary trigger caps. FIG. 15 C-D show the assembly of the latch mechanism with the first kind trigger cap. FIG. 15 E-G show the assembly of the latch mechanism with the second kind trigger cap. FIG. 15 H-J show the assembly of the latch mechanism with the third kind trigger cap. Those skilled in the art will also realize and understand, upon reading this description, that other and or different trigger caps may be used.

The latch mechanism disclosed here can be attached to sashes in various approaches with different screw locations. For example, FIG. 15 H-J show one type of screw locations, where the screw holes are exposed on the housing of the latch mechanism. FIG. 15 C-G show other types of screw locations, where the screw holes are on the base cover of the latch mechanism. These holes are hidden by the top cover and cannot be seen when the latch mechanism is assembled.

FIG. 15 A shows two different types of screw locations on the base cover. Multiple screw locations increase the adaptability of this latch mechanism to many window systems, including but not limited to, sliding window systems and double-hung window systems. Those skilled in the art will also realize and understand, upon reading this description, that other and or different screw locations may be used to adapt this latch mechanism to various window systems.

What is claimed is:

1. A latch mechanism for a window comprising: a housing, a latch bolt, a first resilient element, an actuator, and a second resilient element; the housing defining at least one opening into a cavity therein; the latch bolt slidably disposed in the housing and selectively positionable between an extended position and a retracted position, wherein such latch bolt is biased by the first resilient element toward the extended position; a ridge configured to protrude into the housing cavity; a stopping mechanism adapted to automatically engage and retain the latch bolt in the retracted position as the latch bolt is actuated from the extended position to the retracted position; and the actuator slidably disposed in the housing and including a contactor adapted to slide along the ridge; wherein the actuator is biased from a retracted position, by the second resilient element, to extend outwardly from the housing without actuating the stopping mechanism, as the contactor slides along one portion of the ridge; and the actuator configured, when actuated to retract inwardly into the housing, to disengage the stopping mechanism, as the contractor slides along another portion of the ridge.

2. The latch in accordance with claim 1, wherein the first and second resilient elements each comprise a helical spring.

3. The latch in accordance with claim 1, wherein the stopping mechanism comprises a stopping pin on the latch bolt adapted to releasably engage with a stopping pin on the housing.

4. The latch in accordance with claim 3, wherein the stopping pin on the latch bolt is adapted to be actuated by the contactor on the actuator.

5. The latch in accordance with claim 1, wherein the ridge comprises a chamfer, a stud, an arc side, and a limit wall.

6. The latch in accordance with claim 1, wherein the housing comprises a top housing and a bottom housing configured to be secured to each other; wherein said stopping pin on said housing for said locking mechanism comprises a stopping pin on said bottom housing.

7. The latch in accordance with claim 1, wherein the latch is adapted to secure a double hung window.

8. The latch in accordance with claim 1, wherein the latch is adapted to secure a sliding sash window.

9. The latch in accordance with claim 1 comprising: a trigger cap adapted to be fixedly secured to the latch bolt.

10. The latch in accordance with claim 6, further comprising a hook mechanism configured to secure the top housing to the bottom housing, wherein the hook mechanism comprises a pair of upper hooks on the top housing and a pair of bottom hooks on the bottom housing, and wherein the upper hooks of the top housing are adapted to snap into engagement with the bottom hooks of the bottom housing.

11. A latch for a window comprising: a housing, a latch bolt, a first resilient element, an actuator, and a second resilient element; said housing defining at least one opening therein; said actuator slidably disposed in said housing with said second resilient element adapted to bias said actuator to have a portion thereon normally protrude outward from a first portion of said at least one opening of said housing; said latch bolt slidably disposed in the housing and selectively positionable between an extended position and a retracted position, said first resilient element adapted to bias said latch bolt to have a portion thereon normally protrude outward from a second portion of said at least one opening of said housing, in the extended position; said latch comprising a stopping mechanism adapted to automatically engage and retain said latch bolt in the retracted position as said latch bolt is actuated from the extended position to the retracted position; wherein a portion of said latch bolt is adapted to be actuated by said actuator to disengage said locking mechanism and permit said latch bolt to be biased from the retracted position to the extended position; said housing comprising a selectively shaped ridge; said actuator including a contactor; wherein when said latch bolt is in the retracted position and said actuator is actuated to counter said bias of said second resilient element and retract into said housing, said contactor configured to slide along a first portion of said selectively shaped ridge to disengage said locking mechanism and permit said latch bolt to be biased from the retracted position to the extended position; and wherein when said latch bolt is in the extended position and when said actuator is no longer actuated, said actuator being biased by said second resilient element to slide to extend outwardly from said housing, with said contactor configured to slide along a second portion of said selectively shaped ridge without actuating said locking mechanism.

12. The latch in accordance with claim 11, wherein said stopping mechanism comprises a stopping pin on said latch bolt and a stopping pin on said housing; wherein said stopping pin on said latch bolt is adapted to releasable engage with said stopping pin on said housing.

13. The latch in accordance with claim 12, wherein said stopping pin on said latch bolt is adapted to be actuated by said contactor on said actuator for said disengagement of said locking mechanism.

14. The latch in accordance with claim 13 wherein said housing further comprises a top housing and a bottom housing; wherein said stopping pin on said housing for said locking mechanism comprises a stopping pin on said bottom housing.

15. The latch in accordance with claim 14 further comprising a hook mechanism configured to secure said top housing to said bottom housing, wherein said hook mechanism comprises a pair of upper hooks on said top housing and a pair of bottom hooks on said bottom housing, and wherein said upper hooks of said top housing are adapted to snap into engagement with said bottom hooks of said bottom housing.

16. The latch in accordance with claim 15 further comprising a plug-socket mechanism, wherein said plug-socket mechanism comprises a pair of upper plugs on said top housing and a pair of bottom slots on said bottom housing, and wherein said upper plugs are adapted to plug into said bottom slots.

17. The latch in accordance with claim 16, further comprising a graspable cap configured to be fixedly secured to said latch bolt.

18. A latch comprising:

a housing, said housing comprising at least one opening into a cavity therein; and said housing comprising a stopping pin and a selectively shaped ridge, each protruding into a portion of said cavity;

a first means for biasing;

an actuator slidably disposed within said housing cavity; said first means for biasing configured to bias said actuator to normally have a portion of said actuator protrude out from a first portion of said at least one opening in said housing; said actuator comprising a contactor protruding laterally therefrom;

a second means for biasing;

a latch bolt slidably disposed within said housing cavity; said second means for biasing configured to bias said latch bolt to have a portion of said latch bolt normally protrude out from a second portion of said at least one opening in said housing, to be in an extended position;

said latch bolt comprising stopping pin, said stopping pin of said actuator configured to automatically engage said stopping pin of said housing to releasably secure said latch bolt when actuated into a retracted position within said housing cavity; and wherein actuation of said actuator to counter said bias of said first means for biasing, to position said actuator in a retracted position in said cavity, is configured to drive said contactor of said actuator against said ridge of said housing to cause said stopping pin of said latch bolt to disengage from said stopping pin of said housing.

19. The latch according to claim 18 further comprising a graspable cap configured to be fixedly secured to said latch bolt.

20. The latch according to claim 19 wherein said housing comprises a base housing and a cover housing configured to be secured to each other.

21. The latch according to claim 20 wherein said base housing configured to be secured to said cover housing comprises one or more protrusions configured to be received in one or more corresponding recesses, to releasably secure said base housing portion to said cover housing portion.

22. The latch according to claim 21 wherein said base housing configured to be secured to said cover housing further comprises one or more hooks on said base housing configured to engage one or more corresponding hooks of said cover housing to secure said base housing to said cover housing.

* * * * *